US005205551A

United States Patent [19]

Nagano et al.

[11] Patent Number: 5,205,551

[45] Date of Patent: Apr. 27, 1993

[54] APPARATUS FOR TRANSPORTING SHEET

[75] Inventors: Toshiyuki Nagano, Yokohama; Masanari Shirai, Chigasaki; Masashi Ohashi, Tokyo; Tatsuya Shiratori, Kawasaki, all of Japan

[73] Assignee: Canon Kabushiki Kaisha, Tokyo, Japan

[21] Appl. No.: 860,222

[22] Filed: Mar. 27, 1992

Related U.S. Application Data

[63] Continuation of Ser. No. 494,399, Mar. 16, 1990, abandoned.

[30] Foreign Application Priority Data

| | | | |
|---|---|---|---|
| Mar. 20, 1989 | [JP] | Japan | 1-067917 |
| Apr. 6, 1989 | [JP] | Japan | 1-087462 |
| Apr. 24, 1989 | [JP] | Japan | 1-105641 |
| May 10, 1989 | [JP] | Japan | 1-118093 |
| Jun. 15, 1989 | [JP] | Japan | 1-154054 |
| Jun. 21, 1989 | [JP] | Japan | 1-159312 |

[51] Int. Cl.[5] ..... B65H 5/00

[52] U.S. Cl. ..... 271/225; 271/245; 271/273; 271/184; 271/291; 198/463.4

[58] Field of Search ..... 271/9, 225, 245, 246, 271/265, 266, 273, 291, 184; 198/463.4

[56] References Cited

U.S. PATENT DOCUMENTS

| | | | |
|---|---|---|---|
| 3,194,380 | 7/1965 | Watson | 198/463.3 |
| 3,298,682 | 1/1967 | Gatti | 271/225 |
| 4,391,510 | 7/1983 | Cherian | 271/245 |
| 4,424,964 | 1/1984 | Kikuchi et al. | 271/265 |
| 4,579,446 | 4/1986 | Fujino et al. | 355/24 |
| 4,727,402 | 2/1988 | Smith | 355/14 SH |
| 4,745,439 | 5/1988 | Hanada et al. | 355/14 SH |
| 4,871,163 | 10/1989 | Landa et al. | 271/225 |
| 4,909,374 | 3/1990 | Skrypalle | 271/225 |

FOREIGN PATENT DOCUMENTS

| | | | |
|---|---|---|---|
| 0378177 | 7/1990 | European Pat. Off. . | |
| 115541 | 9/1980 | Japan | 271/225 |

*Primary Examiner*—H. Grant Skaggs

*Attorney, Agent, or Firm*—Fitzpatrick, Cella, Harper & Scinto

[57] ABSTRACT

An apparatus for transporting a sheet includes a first transporting path provided with rollers for transporting the sheet to an image forming section, a second transporting path for conducting the sheet in a direction transverse to the first transporting path, and a control section for controlling the first and second transporting paths so that they can be connected and disconnected to each other.

18 Claims, 14 Drawing Sheets

APPARATUS FOR TRANSPORTING SHEET

This application is a continuation of application Ser. No. 07/494,399 filed Mar. 16, 1990, now abandoned.

BACKGROUND OF THE INVENTION

1. Field of the Invention

The present invention relates generally to an apparatus for transporting a sheet and, more particularly, to a sheet transporting apparatus provided with the function of transporting, for example, a sheet which is inserted one by one from the exterior by manual sheet insertion.

2. Related Background Art

An electronic copying machine 100 of the conventional type shown in FIG. 1 is arranged to transport a sheet inserted by manual sheet insertion in the following manner. A manual sheet insertion tray 101 is inclined to the outside, and a sheet-like transfer medium 102 is fed from the tray 101. The transfer medium 102 is transported by paper feed rollers 103 and 105 and registration rollers 106 and passed toward a drum 110 through the gap between transfer guides 107 and 109. When an image formed on a drum 110 is transferred to the transfer medium 102 as a toner image by means of a transfer charger 111, the transfer medium 102 is separated from the drum 110 by a separation charger 112. Then, the transfer medium 102 is transported over a transport section 113 to a fixing roller section 115, in which the toner image is fixed. The fixed transfer medium 102 is finally discharged to a discharge tray 116. During the above operation, the transfer medium 102 is transported in the same direction.

When a multiple image is to be formed, after the completion of fixation, the transfer medium 102 which has passed through the fixing section 115 is conducted toward a double-sided/multiple-copy sheet transporting path 119 by a medium deflecting plate 117. The transfer medium 102 passes over the path 119 and is again transported toward the drum 110 and the fixing roller section 115. When images are to be formed on the opposite surfaces of the transfer medium 102, the discharge rollers 120 are reversed while discharging the transfer medium 102. The transfer medium 102 is conducted by the medium deflecting plate 117 and is again transported toward the drum 110 over the transporting path 119.

However, the above-described arrangement involves a number of problems. For example, since the manual sheet insertion tray 101 is positioned on the right side of the electronic copying machine 100, an operator needs to incline the tray 101 to the right and set the transfer medium 102 thereon. It is therefore necessary to leave sufficient space on the right side of the copying machine 100, with the result that space efficiency is impaired by the installation of the copying machine 100.

Another problem is pointed out with respect to a conventional arrangement in which the transfer medium 102 is fed from the manual sheet insertion tray 101, provided on the front side of the electronic copying machine 100, in a direction substantially orthogonal to the double-sided/multiple-copy sheet transporting path 119. For example, such a conventional arrangement requires the provision of means for orthogonal transportation, means for positioning the transfer medium 102, means for switching the transport mechanism of the double-sided/multiple-copy sheet transporting path 119, and other associated parts. Accordingly, the copying machine 100 increases in height.

It has also been proposed to use an arrangement such as that shown in FIG. 2. As shown in FIG. 2, a manual sheet insertion tray projects to the right, and a sheet accommodating tray (cassette) is set in a bottom portion of the copying machine on the front side thereof. A double-sided/multiple-copy sheet transporting path is positioned above the sheet accommodating tray. However, this arrangement still presents problems similar to those described above.

SUMMARY OF THE INVENTION

It is therefore an object of the present invention to provide a sheet transporting apparatus which enables manual sheet insertion to be smoothly performed, as well as an image forming system equipped with such a sheet transporting apparatus.

To achieve the above object, according to the present invention, there is provided a sheet transporting apparatus which includes two sheet transporting paths which are positioned in mutually different planes and intersect each other at approximately right angles, and a pair of guide plates operable to move between the two transporting paths at the intersection thereof. The sheet transporting apparatus further includes guide-plate driving means for moving said guide plates from either to the other of the two transporting paths, and sheet transporting means for transporting the sheet from either to the other of the two transporting paths by changing the direction of transportation of the sheet.

This arrangement does not need the space which has been required to dispose two transporting paths one above the other as in a transporting apparatus of the conventional type in which two transporting paths arranged in the same direction are switched therebetween. Accordingly, it is possible to reduce the space required to install the copying machine, that is, to provide a small copying machine. Moreover, the present invention may also be applied to, for example, a double-sided/multiple copying machine of the type which includes a manual sheet insertion transporting path intersecting a part of a re-feeding transporting path at approximately right angles. In this arrangement, the re-feeding transporting path can also be used as a front-type manual sheet insertion transporting path, whereby the inner space of the copying machine can be remarkably reduced.

The above and other objects, features and advantages of the present invention will be apparent from the following description of preferred embodiments of the invention with reference to the accompanying drawings.

DESCRIPTION OF THE PREFERRED EMBODIMENTS

Embodiments of the present invention will be explained below with reference to the accompanying drawings.

Figure 1:
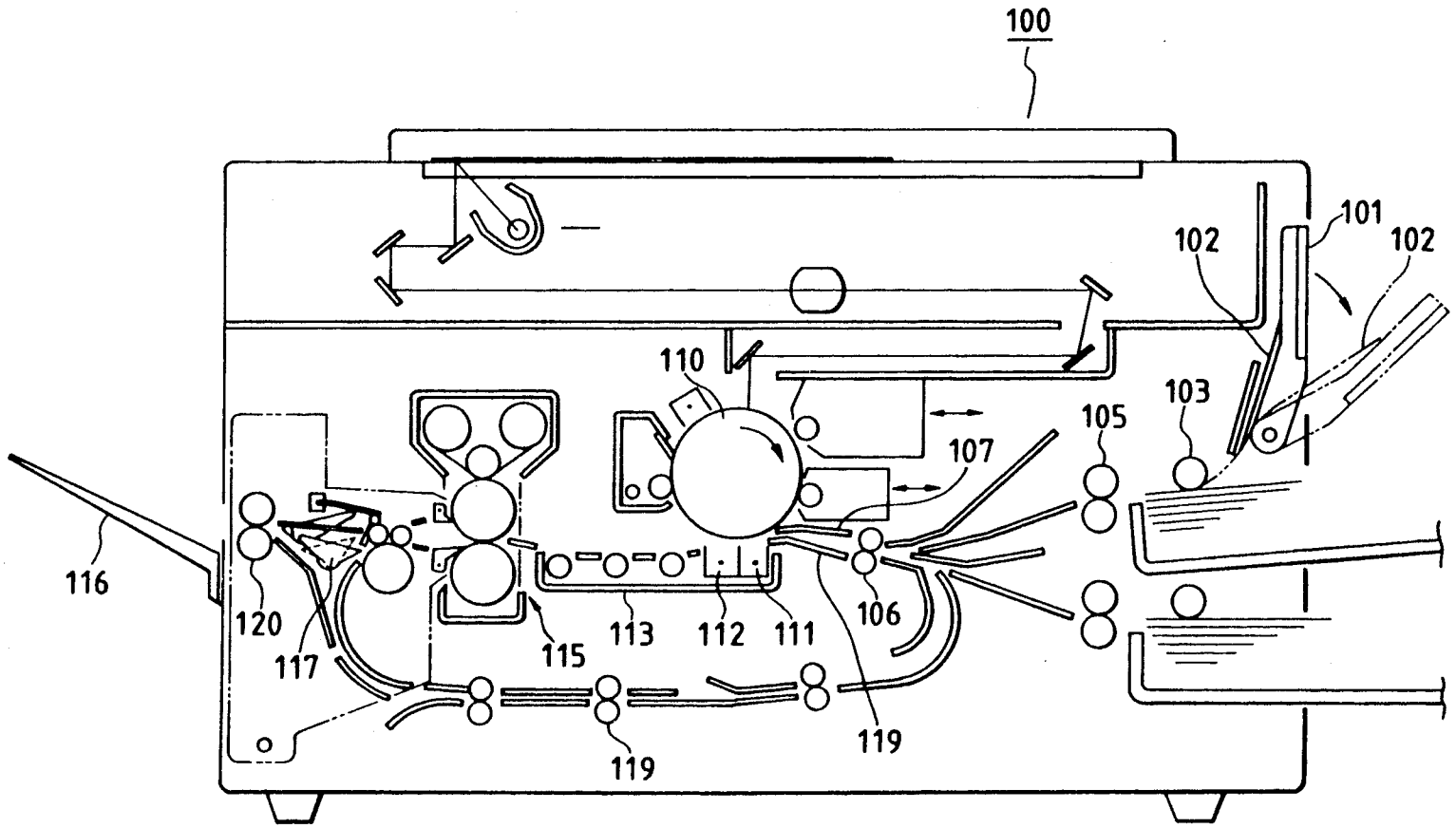
FIG. 1 PRIOR ART
FIG. 1 is a vertical sectional, front elevational view showing a sideways manual sheet insertion type of copying machine provided with a conventional manual sheet insertion mechanism.
Figure 2:
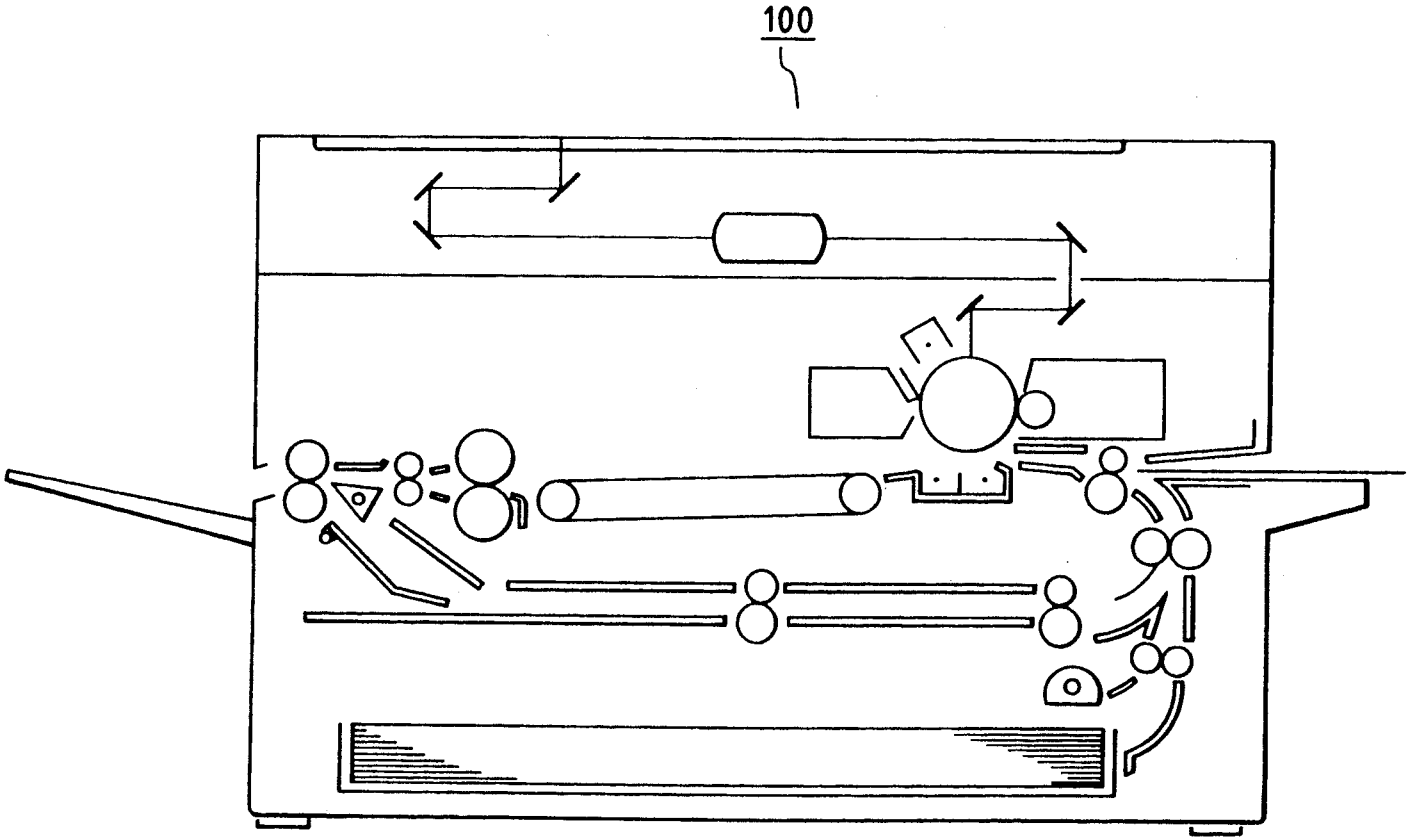
FIG. 2 PRIOR ART
FIG. 2 is a view similar to FIG. 1, and shows a sideways manual sheet insertion type of copying machine provided with a different conventional manual sheet insertion mechanism.
Figure 3:
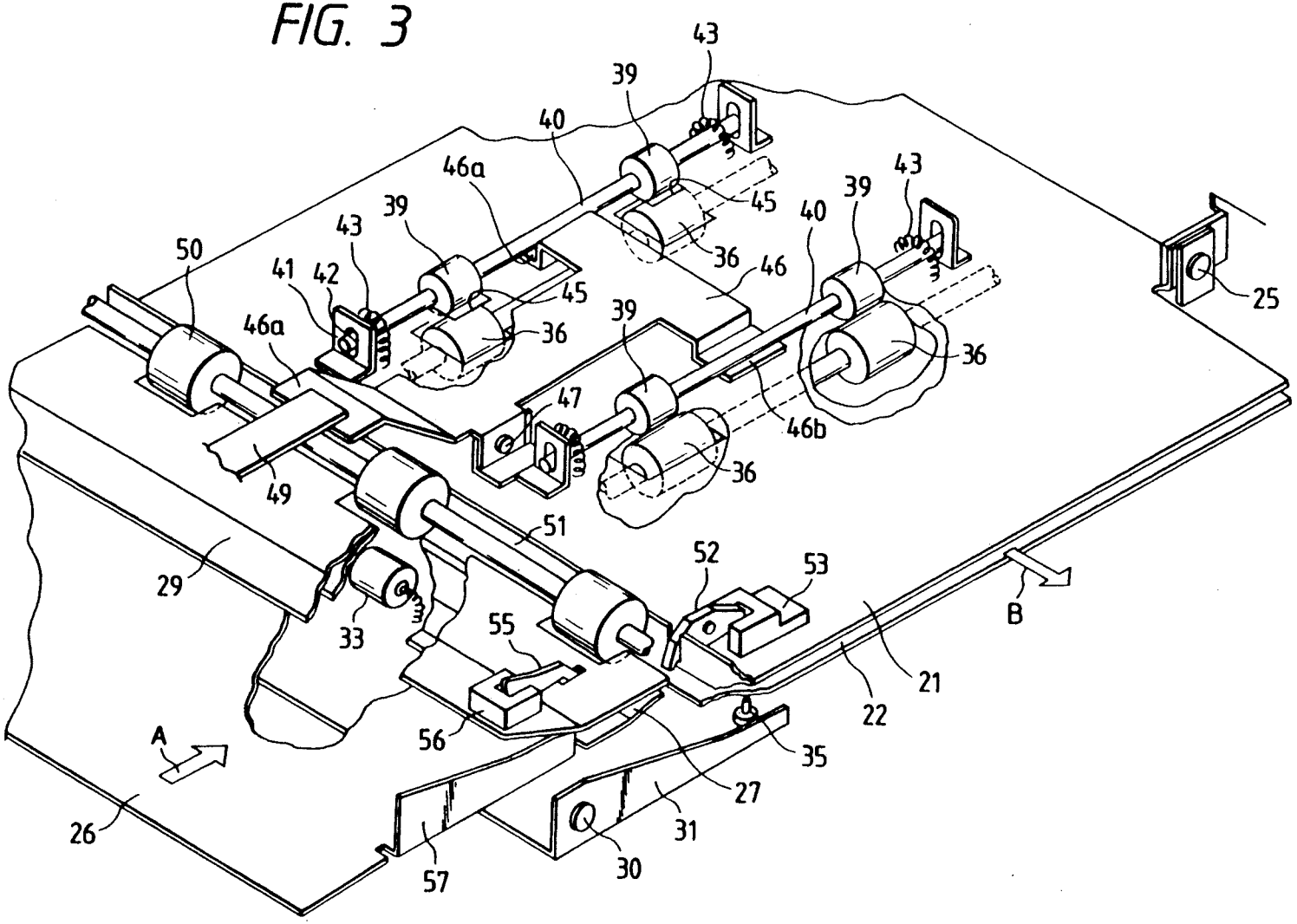
FIG. 3 is a perspective view showing guide plates and associated elements according to a first embodiment of the present invention.
Figure 4:
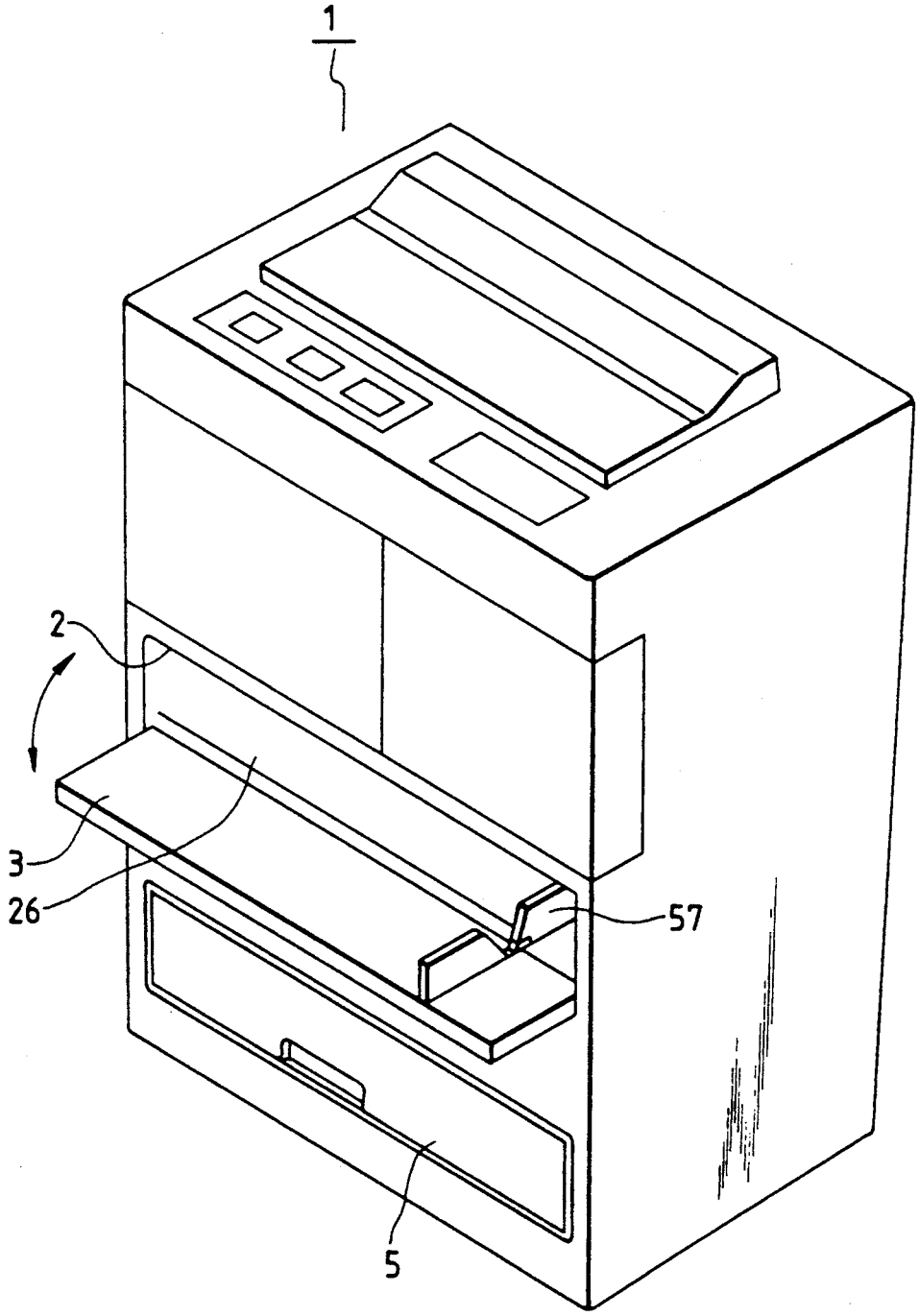
FIG. 4 is a schematic perspective view showing a copying machine to which the present invention is applied.
Figure 5:
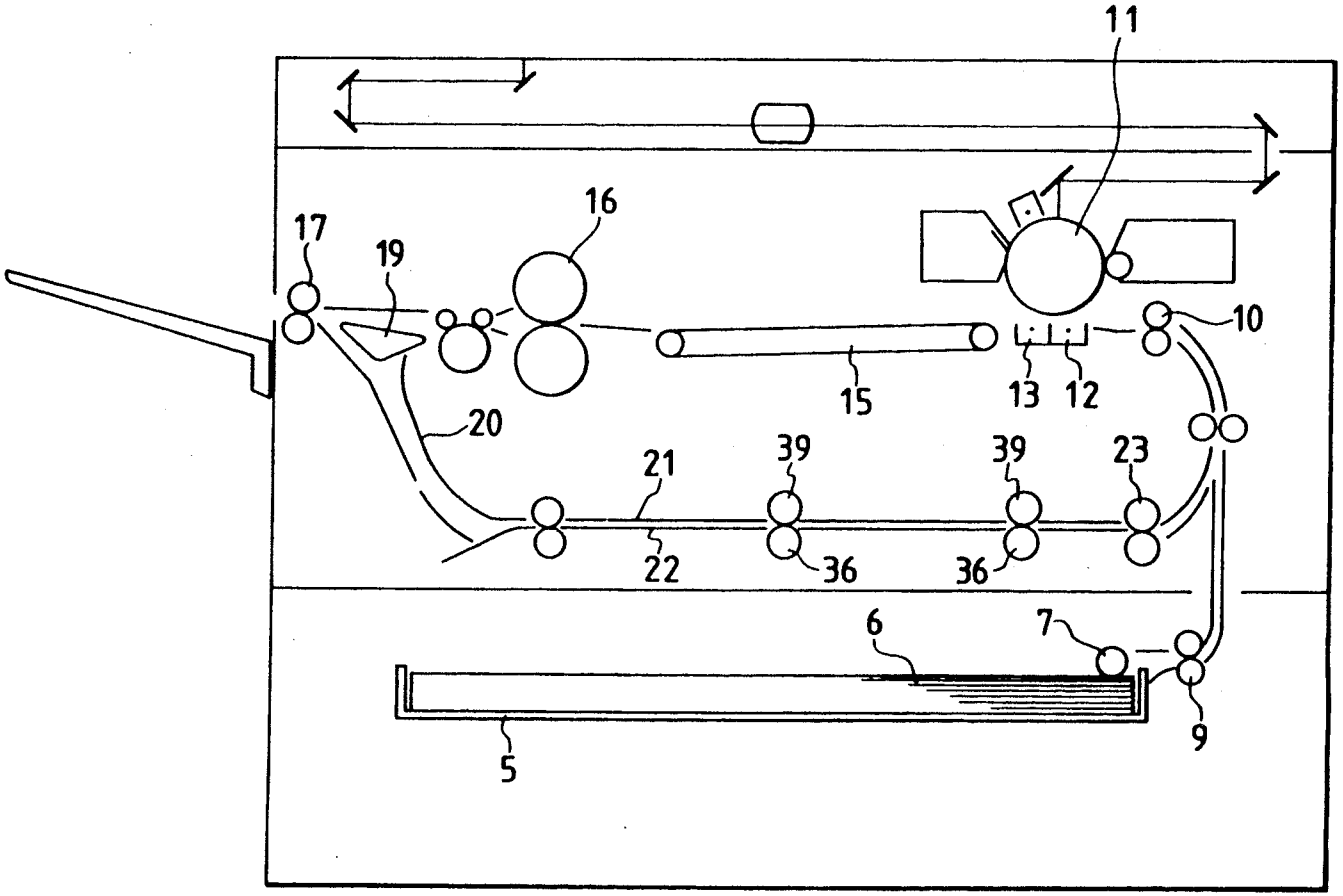
FIG. 5 is a vertical sectional, front elevational view of the copying machine of FIG. 4.

A first embodiment will now be described with reference to FIGS. 3 through 6, in which FIG. 3 is a detailed perspective view showing the first embodiment, FIG. 4 is a schematic perspective view showing the external appearance of a copying machine to which the first embodiment is applied, FIG. 5 is a vertical sectional, front elevational view of the copying machine of FIG. 4, and FIGS. 6A, 6B and 6C are schematic views showing the operation of the first embodiment.

A copying machine 1 is of a front-loading type which is provided with a manual sheet insertion port 2, a swingable manual sheet insertion tray 3 and a cassette 5 on the front side. As shown in FIG. 5, a single sheet 6 is fed from the cassette 5 by a pickup roller 7 and is then transported to registration rollers 10 by means of transport rollers 9. The sheet 6 is synchronously registered with respect to an image formed on a drum 11 by the registration rollers 10, and is transported at a predetermined timing. Thereafter, the image formed on the drum 11 is transferred to the sheet 6 by a charger 12, and the sheet 6 is separated from the drum 11 by a separating charger 13. The sheet 6 is transported over a transporting section 15 to a fixing section 16 for fixation purposes. The sheet 6 having a single image copied on one side is discharged by discharge rollers 17.

If a single image is to be copied on the other surface of the sheet 6, when a substantial portion of the sheet 6 is discharged by the discharge rollers 17, the discharge rollers 17 are reversed and the sheet 6 is transported down to a double-sided/multiple-copy transporting path 20 by a flapper 19.

If a multiple copy image is to be formed on one surface of the sheet 6, the sheet 6 is transported to the double-sided/multiple-copy transporting path 20 by the flapper 19.

If a single image is to be copied on each surface after a multiple copy image is formed on one surface, the sheet 6 is passed through the gap between a pair of guide plates 21 and 22 and again transported toward the registration rollers 10 by re-feeding rollers 23. Thereafter, a predetermined copying operation is performed.

An arrangement for controlling the relation between the manual sheet insertion on the front side and sheet transportation for double-sided/multiple copy will now be explained below with reference to FIGS. 3 and 6A to 6C.

In FIG. 3, the pair of upper and lower rectangular guide plates 21 and 22, which have been explained in connection with FIG. 5, are rotatably secured to the main body of the copying machine 1 in parallel with each other by a pair of right and left pins 25. A manual sheet insertion tray guide 26 is secured to the main body so that its upper surface becomes flush with the upper surface of the manual sheet insertion tray 3 which is open outward (refer to FIG. 4). A lower guide 27 and an upper guide 29 are secured to the main body at a location which immediately follows the manual sheet insertion tray guide 26.

Figure 6A:
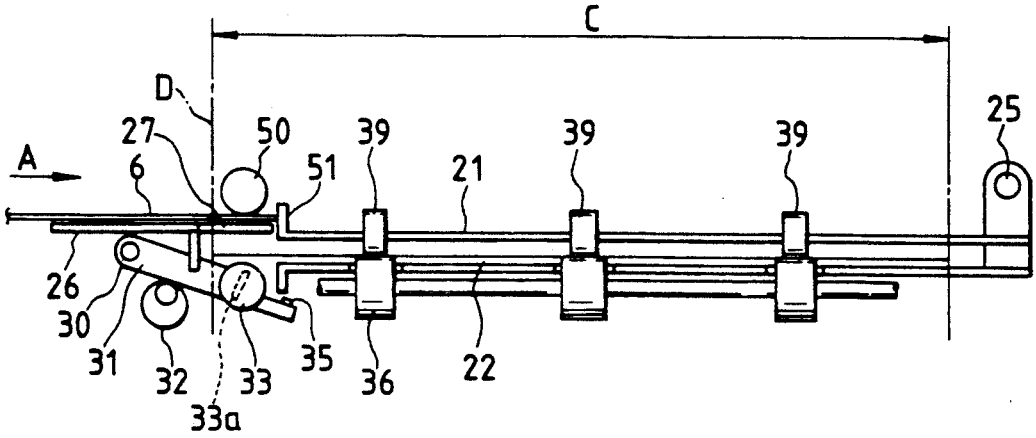
FIGS. 6A, 6B and 6C are side elevational views showing the operation of the guide plates.
Figure 6B:
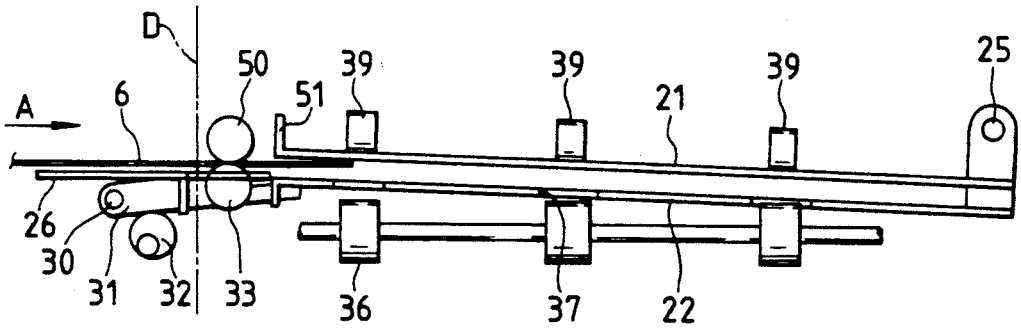
Figure 6C:
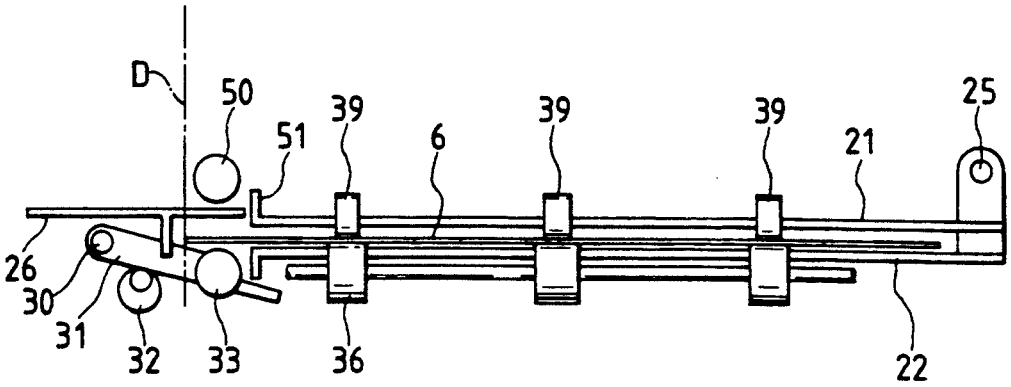

A pressure arm 31 is pivotally supported by pins 30 which are fixed to the main body at a location below the manual sheet insertion tray guide 26 and the lower guide 27. As shown in FIGS. 6A to 6C, the pressure arm 31 is arranged to move up and down by means of an eccentric cam 32 which is driven by a pulse motor or the like (refer to FIG. 9). Driven manual sheet insertion rollers 33, which are normally urged upwardly, are provided on an inner portion of the pressure arm 31, and push-up pieces 35 for pushing up the guide plate 22 are provided on the inner end portion of the pressure arm 31. The shaft of each roller 33 is supported so that it can move up and down and rotate about its axis in the slot 33*a* of the pressure arm 31.

As illustrated, driving rollers 36 for refeeding transportation are rotatably fitted onto shafts which extend from front to rear, and are engaged and disengaged through a clutch (not shown) by a drive source (not shown). The guide plate 22 is provided with openings 37, through which corresponding driving rollers 36 are inserted. Driven rollers 39 for re-feeding transportation, which are formed integrally with shafts 40, are opposed to the respective driving rollers 36. Brackets 41 each having a vertical slot 42 are secured to the guide plate 21, and the opposite ends of each shaft 40 are engaged with the engaging slots 42 and urged together with the driven rollers 39 in the downward direction by tension springs 43. Openings 45, through which the corresponding rollers 39 are inserted, are formed in the guide plate 21. A roller release arm 46 having engaging portions below the shafts 40 is pivotally supported by a pivot pin 47 fixed to the guide plate 21, and one end 46*a* of the roller release arm 46 is formed to engage with the underside of a projecting piece 49 fixed to the main body. Driving manual sheet insertion rollers 50 are disposed to insert through the upper guide 29 in the downward direction. The driving rollers 50 are rotated and opposed to the driven manual sheet insertion rollers 33 by the driving of a pulse motor or the like. A reference guide 57 for guiding the manually inserted sheet 6 is formed substantially perpendicularly to the upper surface of the manual sheet insertion guide 26 on the right side thereof (as viewed in FIG. 3).

Restricting means for restricting the direction of a manually fed sheet will be explained below.

The outer end portion of the guide plate 21 is bent upwardly at substantially right angles to form a shutter portion 51. The shutter portion 51 is provided with a sensor lever 52 which comes into contact with the leading edge of the sheet 6 when this leading edge strikes the shutter portion 51. A photo interrupter 53 is combined with the sensor level 52 to effect sensing operation. The upper guide 29 is provided with a sensor lever 55 and a photo interrupter 56 which is combined therewith to detect the trailing edge of the manually inserted sheet 6.

As shown in FIGS. 6A to 6C, manual sheet insertion roller pairs each consisting of the driving roller 50 and the driven manual sheet insertion roller 33 are positioned within a region C through which the sheet 6 passes during the operation of double-sided copy or multiple copy. The limit line D of the region C is shown by a dot-dashed line.

The operation of manual sheet insertion will be explained below.

During a double-sided/multiple-copy operation, as shown in FIG. 6A, the eccentric cam 32 is held in its minimum eccentric position and the pressure arm 31 is kept in the lowermost position. The left ends of the respective guide plates 21 and 22 which are supported by the push-up pieces 35 provided on the inner end portion of the pressure arm 31, are positioned below the upper surface of the manual sheet insertion tray guide 26, while the shutter portion 51 crosses the plane of the upper surface of the tray guide 26. In this position, the re-feeding transportation driven and driving rollers 39 and 36 cooperate to perform a normal re-feeding operation. More specifically, neither of the driving and driven manual sheet insertion rollers 50 and 33, which are positioned in the region C through which the sheet 6 is passed for the purpose of double-sided copy or multiple copy, interferes with the sheet 6 during re-feeding.

In the above state, an operator determines that neither double-sided copy mode nor multiple-copy mode is active, and opens the manual sheet insertion tray 3, which also serves as a cover, in the direction indicated by the arrow of FIG. 4. Then, the operator inserts the sheet 6 through the manual sheet insertion port 2 along the reference guide 57 in the direction of an arrow A until the leading edge of the sheet 6 strikes the shutter portion 51 (the leading edge of the sheet 6 presses the sensor lever 52 to switch the apparatus to a manual sheet insertion mode). Thus, a manual-sheet-insertion start signal is generated by a button (not shown).

In response to this signal, a control section causes the eccentric cam 32 to rotate through approximately 180 degrees, thereby moving the pressure arm 31 upward. Thus, the guide plates 21 and 22 are rotated upwardly about the pins 25 by means of the push-up pieces 35 (refer to FIG. 3) to keep the upper surface of the guide plate 22 slightly below the upper surface of the lower guide 27.

It is to be noted that the dimensions of the pressure arm 31 and the eccentric cam 32 are selected so that all the re-feeding transportation driving rollers 36 are positioned below the upper surface of the guide plate 22.

The driven manual sheet insertion rollers 33 are pressed, by upward urging force, against the corresponding driving manual sheet insertion rollers 50 via the manually inserting sheet 6 engaged with the shutter portion 51, while the shutter portion 51, hence the guide plate 21, moves upward. At this time, the nips between the rollers 33 and 50 oppose the guide space defined between the guide plates 21 and 22. Simultaneously, since the end **46*a* of the roller release arm 46 is brought into engagement with the projecting piece 49, the roller release arm 46 rotates about the pivot pin 47 to move an inner-side portion 46*b* upward, thereby moving up the shafts 40 against the downward urging force of the tensile spring 43. Thus, the refeeding transportation driven rollers 39 move to a position above the underside of the guide plate 21**.

When the above eccentric cam 32 has rotated through approximately 180 degrees, a signal is transmitted to the control section. In response to the signal, the control section drives the manual sheet insertion rollers 50 to transport the manually inserted sheet 6 toward the inner side at a predetermined speed.

Then, after the trailing end of the sheet 6 has been detected by the sensor lever 55 and the photo interrupter 56, the sheet 6 is transported by a predetermined distance and the driving and driven manual sheet insertion rollers 50 and 33 are stopped. This movement causes the trailing end of the sheet 6 to coincide with the limit line D of the region C described above.

Then, when the control section receives a signal indicating that the drive source for driving the driving manual sheet insertion rollers 50 have stopped, the control section turns on a drive source for the eccentric cam 32 to cause it to rotate through approximately 180 degrees. As shown in FIG. 6C, the pressure arm 31 moves down and is reset to the state explained in connection with FIG. 6A.

Then, when the control section receives a signal indicating that the drive source for driving the eccentric cam 32 have stopped (or the control section counts a predetermined number of pulses), the control section drives the re-feeding transportation driving and driven rollers 36 and 39 to transport the manually inserted sheet 6 in a direction substantially perpendicular to the direction of manual insertion (in the direction indicated by the arrow B of FIG. 3). Subsequently, the sheet 6 is again transported to an image forming region (including elements such as the drum 11, the fixing section 16) by means of the re-feeding rollers 23 (refer to FIG. 5) and the registration rollers 10.

A second embodiment will now be explained with reference to FIG. 7.

Figure 7:
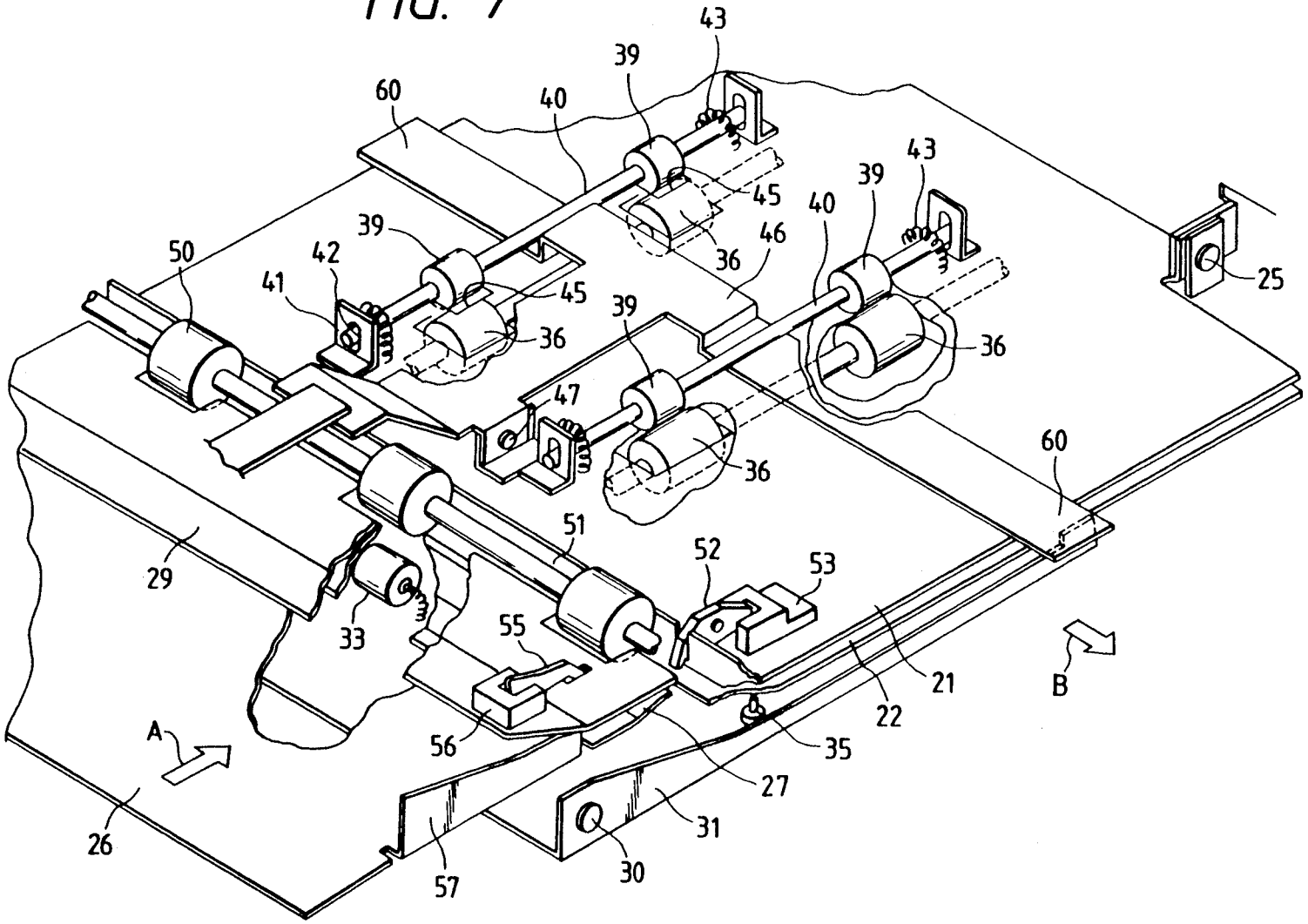
FIG. 7 is a perspective view showing guide plates and associated elements according to a second embodiment of the present invention.

In FIG. 7, the same reference numerals are used to denote elements which has the same arrangement and operation as those shown in FIG. 3 and explanation will be omitted for the sake of simplicity.

The second embodiment differs from the above-mentioned first embodiment in that the roller release roller 46 have a different configuration. Engagement arms 60 for engaging the respective shafts 40 from below extend in opposite directions. The projecting piece 49, which has been shown as fixed to the main body in FIG. 3, is omitted. The pressure arm 31 extends so as to engage with the underside of each engagement arm 60.

In the above arrangement, as the pressure arm 31 moves up the guide plates 21 and 22, the extending end of the pressure arm 31 engages with the roller release arm 46 and moves it up about the pivot pin 47, whereby operation similar to that of the first embodiment can be achieved.

Although, in the first embodiment, the home position of the guide plates 21 and 22 is placed below the manual sheet insertion tray guide 26, the positional relationship therebetween may be reversed. More specifically, the pressure arm 31, the pins 30, the eccentric cam 32 and the like may be positioned above the manual sheet insertion tray guide 26 and the positional relation between the driving and driven manual sheet insertion rollers 50 and 33 may be reversed vertically. Accordingly, the guide plate 21 is moved down so as to take the position shown in FIG. 6B. Similarly, the positional relation between the re-feeding transportation driving and driven rollers 36 and 39 may be reversed vertically. With such an arrangement as well, it is possible to achieve the operation of manually inserting the sheet 6, as in the case of the first embodiment.

In the first embodiment, although the guide plates 21 and 22 are urged downwardly, they are pressed against the pressure arm 31 to be free from vibration. However, in the second embodiment, the guide plates 21 and 22 may be urged upwardly to be pressed against the pressure arm 31 disposed above the guide plates 21 and 22.

Figure 8:
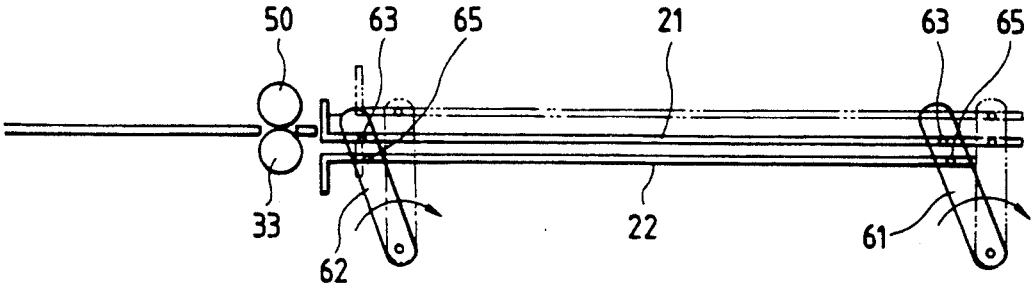
FIG. 8 is a schematic side elevational side view showing guide plates according to a third embodiment of the present invention.

A third embodiment will now be explained with reference to FIG. 8.

In the third embodiment, the guide plates 21 and 22 are arranged not integrally but separately, and they are pivotally supported by pins 63 and 65, respectively, each of which is rotatably supported by parallel links 61 and 62. The rotational driving of the parallel links 61 and 62 serves the function of the pressure arm 31 and the eccentric cam 32 to move the guide plates 21 and 22 up and down. It is also possible to apply the remove pressure to and from the re-feeding transportation driven rollers. In the third embodiment, although the guide plates 21 and 22 are pivotally supported by each of the links 61 and 62, the guide plates 21 and 22 may be formed as an integral arrangement and the pin 63 or 65 may be disposed on one side to pivotally support it.

According to any of the above-described first to third embodiments of the present invention, the direction of transportation of a manually inserted sheet 6 is restricted by restricting means 51 which is formed from a part of guide means 21, 22, and the sheet 6 is then fed from a first transporting path 20 by means of the guide means 21, 22. Accordingly, it is possible to prevent the skew feed or imperfect feed of the sheet 6 so that images can be prevented from being formed in an offset manner. In addition, since no special means is needed, for example, the restricting means 51 is formed from a part of the guide means 21, 22, it is possible to provide a transporting apparatus of a simple structure, a small size and a low cost.

In each of the above-described embodiments, the sensor lever 55 and the photointerrupter 56 used for positioning the sheet 6 are disposed on the outer side of the guide plates 21 and 22 (on the upstream of the region C shown in FIG. 6). However, an equivalent means may be disposed in the middle of or on the inner side of the region C. For instance, if a reference point is disposed on the inner side, a plurality of pairs of manual sheet insertion rollers may be disposed and a sensor may be provided for detecting the leading end of the sheet 6 which reaches the vicinity of the inner reference point.

Although, in each of the above embodiments, the guide plates 21 and 22 are moved up and down to move the re-feeding transportation driving and driven rollers 36 and 39 into and out of the transporting path for the sheet 6, the driving and driven rollers 36 and 39 may be shifted independently.

Figure 9:
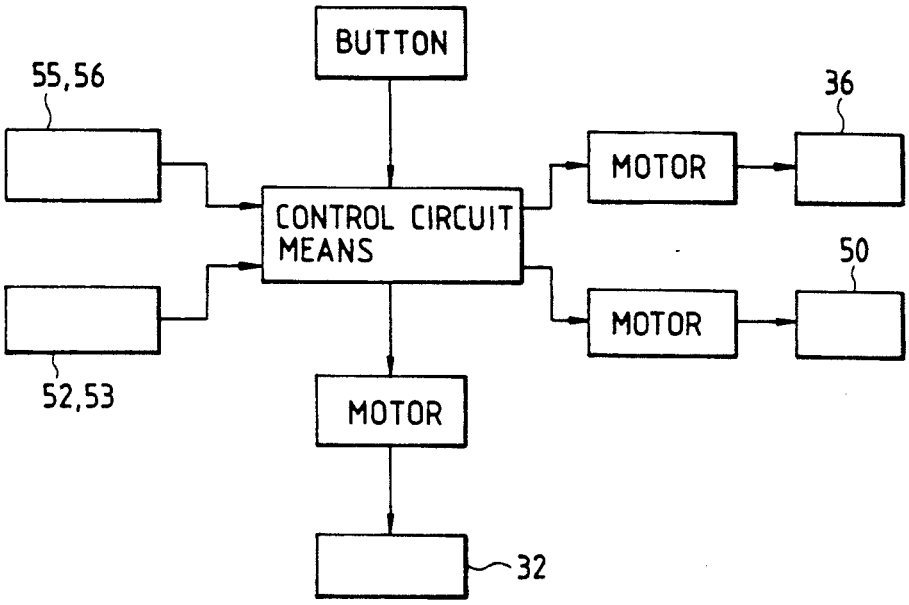
FIG. 9 is a block diagram.

Each of the above embodiments includes a control circuit such as that shown in FIG. 9. In FIGS. 3–8, the respective motors for actuating the eccentric cam 32, the driving manual sheet insertion rollers 36, and the driving manual sheet insertion rollers 50 are not shown.

An arrangement for temporarily holding the sheet 6 while the guide means is being moved will now be explained in detail with specific reference to FIG. 6.

When the control section receives a signal indicating that the drive source for driving the driving manual sheet insertion rollers 50 have stopped, the control section turns on the drive source of the eccentric cam 32 to cause it to rotate through approximately 180 degrees. As shown in FIG. 6C, while the pressure arm 31 is moving down, the guide plates 21 and 22 reach the position shown in FIG. 6A, but the shaft of the driven manual sheet insertion rollers 33 is positioned above the middle of the pressure arm 31. Accordingly, the rollers 33 are urged upward and pressed against the driving manual sheet insertion rollers 50. (This state corresponds to an intermediate state between the states show in FIGS. 6B and 6C).

When the pressure arm 31 reaches its lower limit, the top end of the slot 33*a* forces the rollers 33 down into the state shown in FIG. 6C, against the upward urging force of the rollers 33. Thus, preparation for returning to the state shown in FIG. 6A is ready. More specifically, the manually inserted sheet 6 is first nipped between the rollers 50 and 33 and, then, while it is being transported from the rollers 50 and 33 to the rollers 36 and 39, it is nipped between the rollers 50 and 33 and the rollers 36 and 39. Accordingly, the manually inserted sheet 6 is continuously held.

Then, the pressure arm 31 moves down as shown in FIG. 6C and the mechanism is reset to the state explained in connection with FIG. 6A. However, the sheet 6 is nipped between the driving and driven rollers 36 and 39 for re-feeding transportation.

Figure 10:
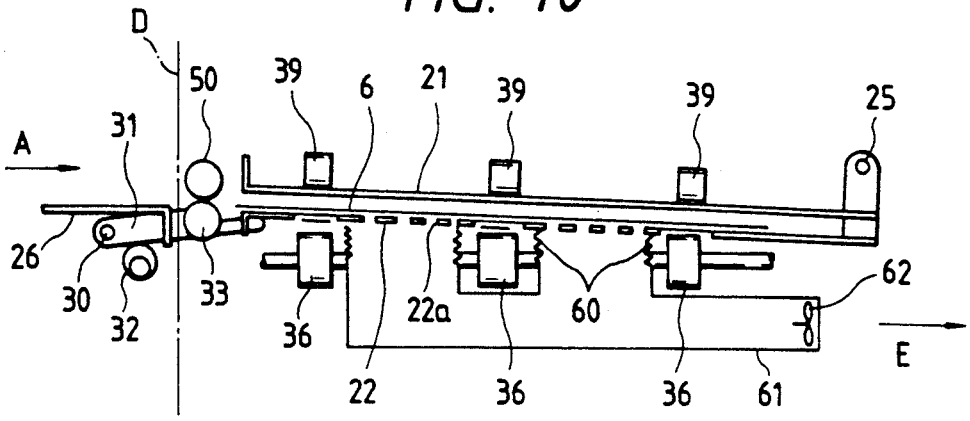
FIG. 10 is a schematic sectional view showing a sheet pressing means according to a fourth embodiment of the present invention.

A temporary holding means according to the fourth embodiment will be explained below with reference to FIG. 10. The same reference numerals are used to denote members which have the same arrangement and operation as those used in each of the aforesaid embodiments, and description thereof is omitted.

Each of the aforesaid embodiments is arranged to continuously hold the manually inserted sheet 6 by means of the slots 33*a* of a selected length which are formed in the pressure arm 31. In the fourth embodiment, the guide plate 22 is held on the guide plate 22 by evacuation.

The guide plate 22 has a multiplicity of holes 22*a* and a bellows 60 is secured to the underside of the guide plate 22 to enclose the holes 22*a*. A duct 61 extending from the bellows 60 is secured to the copying machine 1, and a fan 62 is disposed in the extending end of the duct 61. When this fan 62 is actuated by a motor (not shown), the air in the duct 61 is discharged in the direction indicated by the arrow E of FIG. 10 to reduce the pressure in the duct 61. Thus, the sheet 6 is held on the guide plate 22 by evacuation through the holes 22*a*.

When the manually inserted sheet 6 is transported by means of the rollers 33 and 50 and the trailing edge of the sheet 6 reaches the limit line D, the control section receives a signal indicating that the drive source for actuating the rollers 50 has stopped, and actuates the motor of the fan 62 to cause it to rotate, thereby holding the sheet on the guide plate 22. A short time after the fan 62 starts to rotate, the control section turns on the drive source of the eccentric cam 32 to cause it to rotate through approximately 180 degrees. When the state shown in FIG. 6C is reached, the control section stops the drive source of the eccentric cam 32 and the motor of the fan 62 at the same time.

If the fourth embodiment is to be used in practice, the fine adjustment of the length of each slot 33*a* which is needed in the above embodiments may be omitted. In addition, the fourth embodiment may be combined with any of the aforesaid embodiments.

As is apparent from the foregoing, according to the fourth embodiment, while the aforesaid guide plates 21, 22 are moving into alignment with another transporting path 20, the sheet 6 is temporarily secured in position by holding means 33*a*, 33 or 62. Accordingly, the sheet 6 is transported without the risk of being offset from position, whereby the accuracy of transportation of the manually inserted sheet 6 is improved. The present invention may be applied to, for example, a double-sided/multiple copying machine provided with the manually inserted sheet transporting path 26 which leads to a part of the re-feeding transporting path in the direction substantially perpendicular thereto. In this arrangement, the re-feeding transporting path 20 can also be used as a front manual sheet insertion transporting path so that substantial space savings can be achieved in the copying machine. In addition, as compared with a conventional sideways manual sheet insertion type of copying machines, it is possible to reduce the space required to install the copying machine and also to improve the economy thereof.

A fifth embodiment which includes transporting means provided on a cover member and switching will be explained below.

Figure 11:
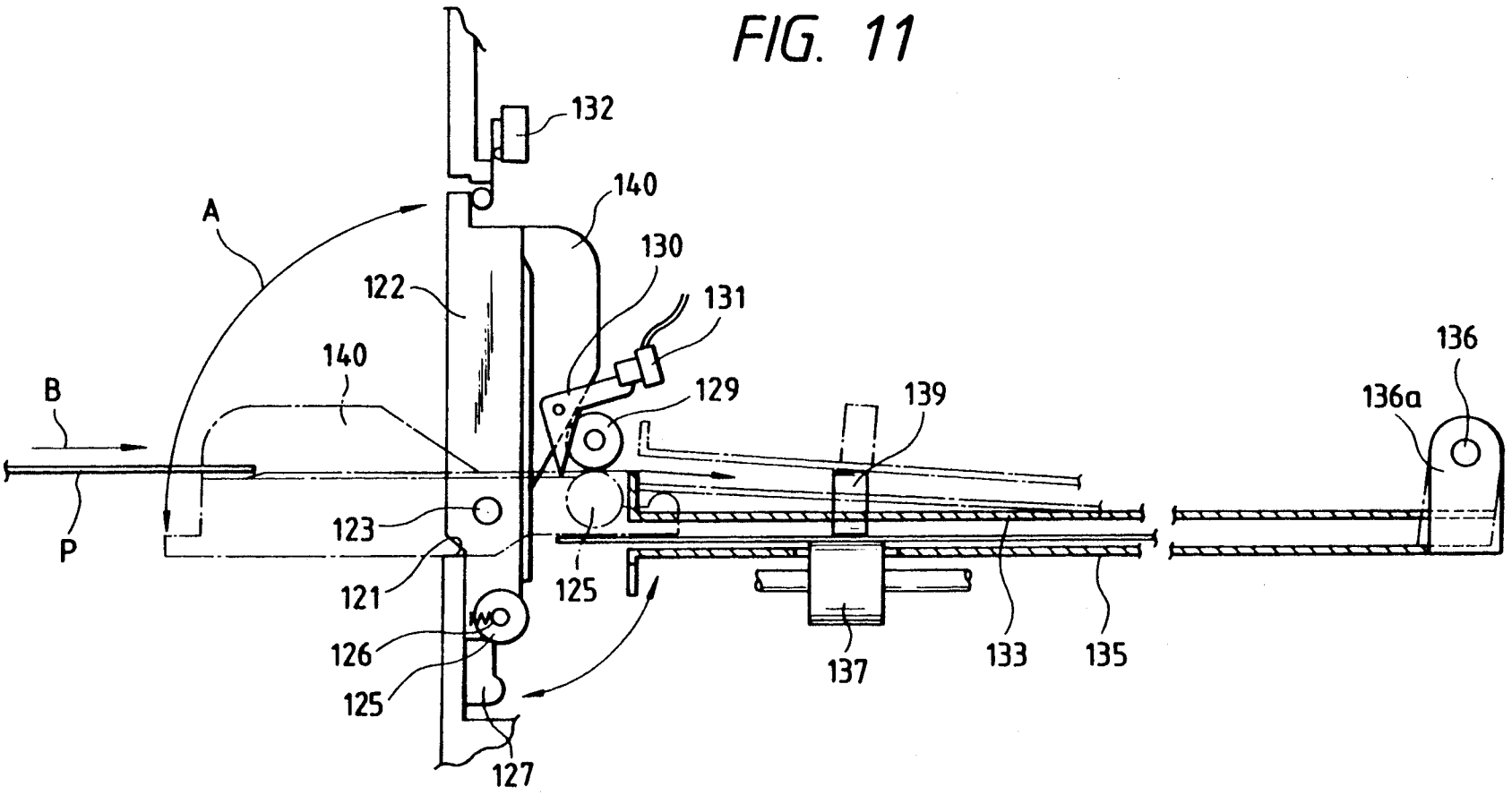
FIG. 11 is a sectional view partially omitted showing a fifth embodiment in which a switch is switched over by means of a swingable cover.

Referring to FIG. 11, a manual sheet insertion opening is denoted by 121, and a manual sheet tray (cover member) 122 is pivotally supported by a shaft 123 so that it can rotate as indicated by the arrow A. Driven manual sheet insertion rollers 125 are disposed on the lower portion (as viewed in FIG. 11) of the manual sheet tray 122 and urged inwardly by spring means 126. A projection 127 is provided on one side of the lower end portion of the manual sheet insertion tray 122 which can be placed into a horizontal open state (the position shown by a dot-dashed line), driving manual sheet insertion rollers 129, which are provided on the main body of the copying machine, are pressed against the driven rollers 125 and actuated by a drive source motor. A member 130 for sensing the reference end (the trailing end) of transfer paper P is pivotally supported on the copying machine 1 on the outer side of the position of the driving rollers 129, and an interrupter 131 is disposed for sensing the reference end of the transfer paper P from the motion of the sensing member 130. A sensing means 132 for detecting whether the opening and closing of the upper end of the manual sheet insertion tray 122 is open or closed, is attached to the copying machine 1. If the open state is detected, the manual sheet insertion inhibit command is executed and a command to enable a sheet to be fed from the cassette 5 is issued.

Guide plates 133 and 135 for guiding the transfer paper P are formed into an integral member and bracket means 136*a* is formed on the inner end thereof, the bracket means 136*a* being pivotally supported by a pin 136 fixed to the copying machine 1. When the guide plates 133 and 135 are held in a horizontal position, the center plane between is positioned below the upper surface of the open manual sheet insertion tray 122 which is in the open position. When the manual sheet insertion guide 122 is opened, the inlet in the center plane between the guide plates 133 and 135 becomes substantially flush with the guide surface of the open manual sheet insertion guide 122.

A main-body transportation driving roller 137 is adapted to be actuated by a drive source motor, and is rotatably disposed on the copying machine 1 in such a manner that its axis extends from front to rear of the machine 1. A pressure roller 139 is disposed in opposition to the driving roller 137 above the guide plate 133 so that it can move upward when the guide plate 133 tilts. As a mechanism for moving the pressure roller 139 up away from the guide plate 33, various mechanisms such as those shown in FIGS. 3 and 7 may be utilized. For example, the pressure roller 139 may be moved up by tilting the guide plate 33 and turning on a solenoid or the like. The pressure roller 139 may be attached to an arm pivotally supported by the copying machine 1 so that the tilting guide plate 133 moves up the arm. In the arrangement shown in FIG. 11, a guide 140 is disposed on one side of the manual sheet insertion tray 122 so as to guide the side end of the manually inserted sheet 6.

In the fourth embodiment having the above-described arrangement, when the manual sheet insertion tray 122 is opened from the manual sheet insertion opening 121, the sensing means 132 is switched off to stop the pick-up roller 7 positioned in the cassette 5, thereby inhibiting feeding from the cassette 5. Simultaneously, the projection 127 tilts the integral guide plates 133 and 135 to oppose the center plane therebetween to the upper surface of the manual sheet insertion tray 122. In the meantime, the main-body transportation driving roller 137 moves outward (downward) away from the guide plate 135, and the pressure roller 139 projects from at least the underside of the guide plate 133 to a small extent. In consequence, the manually inserted transfer paper P can be smoothly inserted into the gap between the guide plates 133 and 135, and the driven manual sheet insertion rollers 125 press against the corresponding driving rollers 129.

Then, when the transfer paper P is manually fed over the tray 122 along the guide 140 in the direction of an arrow B in FIG. 11, the leading end of the transfer paper P presses the sensing member 130 and the interrupter 131 is turned on to detect the insertion of the transfer paper P. In response to a signal indicative of the insertion, the driving manual sheet insertion rollers 129 are rotated to transport the transfer paper P. When the trailing end (reference end) of the transfer paper P passes the sensing member 130 and the sensing member 130 inclines downward, the interrupter 131 is turned off and, in accordance with the interrupter-off signal generated at this time, the reference end of the transfer paper P is stopped at a main-body transportation reference line 141 of the transfer paper P.

Then, when the manual sheet insertion tray 122 is closed, the guide plates 133 and 135 are reset to the horizontal position, and the rollers 125 and 129 nip the transfer paper P and, simultaneously, the driven manual sheet insertion rollers 125 move away from the transporting path. The sensing means 132 is turned on and, in accordance with the on signal generated at this time, the main-body transportation driving roller 137 is rotated to transport the manually inserted transfer paper P for the purpose of image formation.

Figure 13:
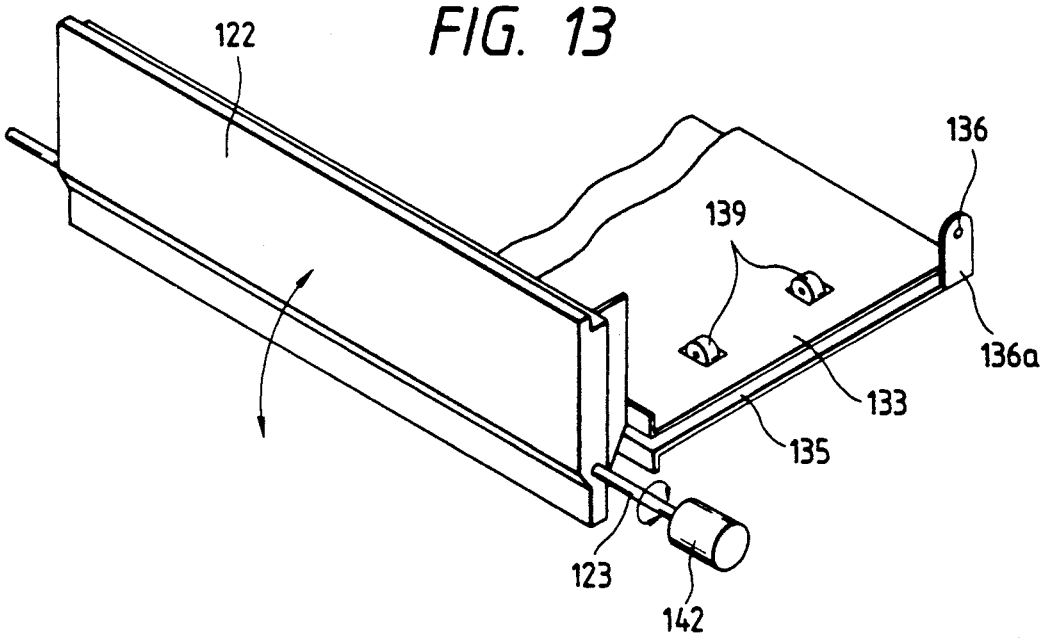
FIG. 13 is a schematic perspective view showing one modification of the sixth embodiment in which a switch is switched over by means of a swingable cover.

As shown in FIG. 13, the manual sheet insertion tray 122 may be formed integrally with the shaft 123 so that the shaft 123 can be rotated forward or backward by means of a motor 142 to achieve the above manual sheet insertion and the feeding of sheets from the main body.

Figure 12:
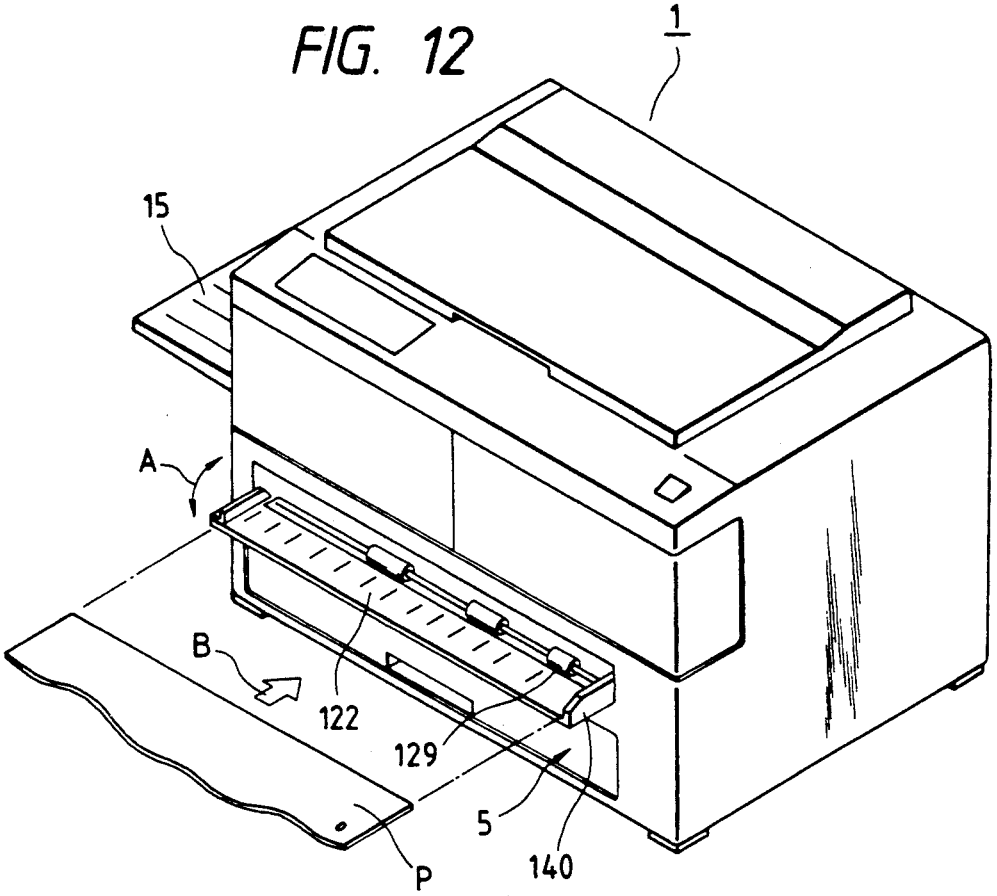
FIG. 12 is a schematic perspective view provided with the arrangement shown in FIG. 11.

As is apparent from the foregoing, according to the embodiment shown in FIGS. 11 to 13, the closing of the aforesaid manual sheet insertion tray 22 is utilized to effect the release of the manual sheet insertion device 25, 29, the shifting of the guide means 33, 35 to a first transporting path 19, the pressing of transporting means 37, 39, and the actuation of a sheet inserting device 3. Accordingly, it is possible to remarkably simplify the structure of a sheet transporting apparatus of the front manual sheet insertion type, and also to greatly reduce the cost. Since a second transporting path 22 for manual sheet insertion is substantially flush with the first transporting path 19 for transporting the sheet P, it is possible to reduce the required installation space without the need to increase the height of the machine. Moreover, since a manual sheet insertion opening 21 can be covered, dangers are prevented and the external appearance is improved.

A sixth embodiment arranged to press the sheet 6 sequentially from the side of the reference end will be explained below.

Referring to FIGS. 14 through 17, the brackets 41 are fixed in position, and a roller release arm 246 is supported by the pin 47 for pivotal motion with respect to the brackets 41. Brackets 242, each having a rectangular configuration in cross section, are formed on the opposite sides of one end of each arm 246, respectively, and vertically extending slots **242*a* are formed in the respective legs of the bracket 242. The shafts 40 of the driven re-feeding transportation rollers 39 are inserted through the corresponding slots 242*a* so as to be restricted in the lateral direction and slidable in the vertical direction. The outer end 246*a* of the roller release arm 246 is arranged to engage with the underside of the projection 49 fixed to the main body of the copying machine 1. The shafts 40 and the driven rollers 39 are urged downwardly by the respective tension springs 43, and the guide plate 21 has the openings 45 through which the corresponding rollers 39 project from the guide plate 21**.

The operation of manual sheet insertion will be explained below.

Figure 15A:
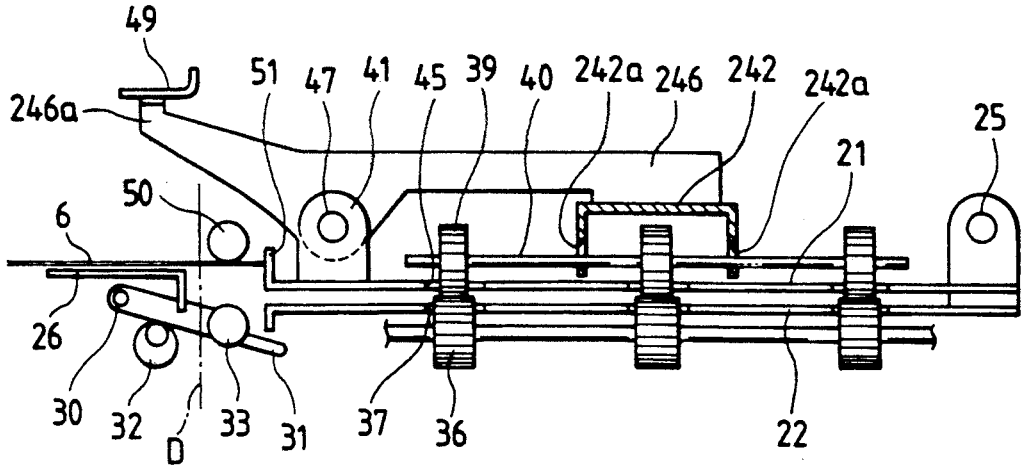
FIGS. 15A, 15B, 15C and 15D are side elevational views showing the operation of the arrangement of FIG. 14.
Figure 15B:
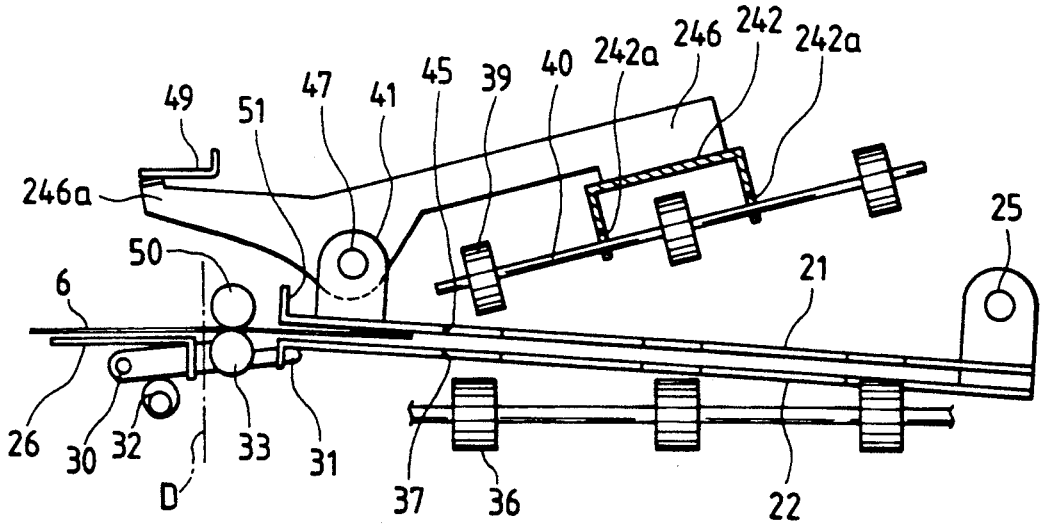

As shown in FIG. 15A, during a double-sided/ multiple copy operation, the eccentric cam 32 is held in its minimum eccentric position and the pressure arm 31 is kept in the lowermost position. The left ends of the respective guide plates 21 and 22, which are supported by the push-up pieces 35 provided on the inner end portion of the pressure arm 31, are positioned below the upper surface of the manual sheet insertion tray guide 26, while the shutter portion 51 crosses the plane of the upper of the tray guide 26. In this position, the re-feeding transportation driven and driving rollers 39 and 36 cooperate to perform a normal re-feeding operation. More specifically, neither of the driving and driven manual sheet insertion rollers 50 and 33, which are positioned in the region C used for double-sided/ multiple-copy transportation, interferes with the sheet 6 during re-feeding.

Figure 14:
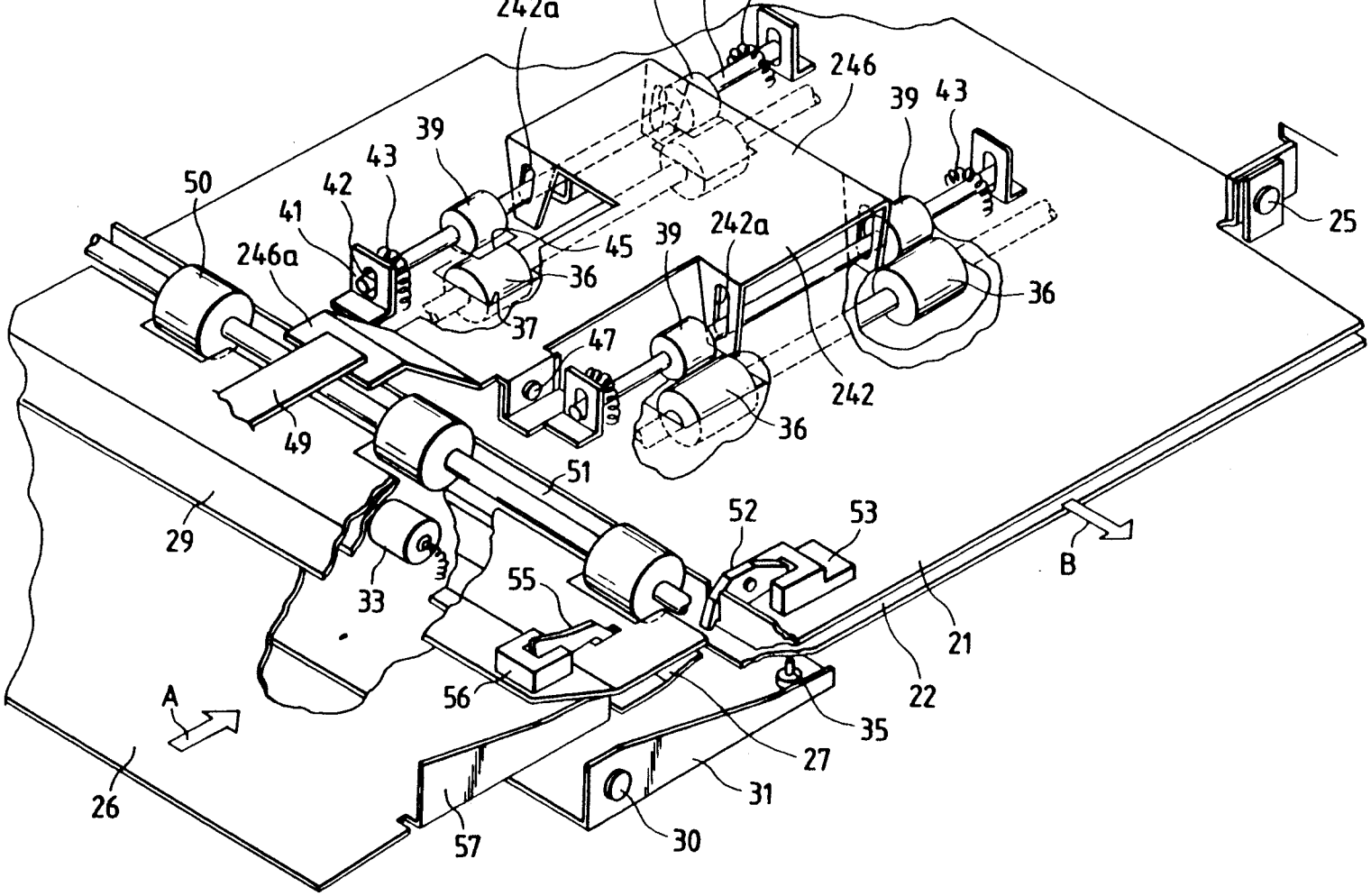
FIG. 14 is a perspective view showing guide plates and associated elements according to a sixth embodiment in which a sheet is pressed in sequence from its reference side.

In the above state, an operator determines that neither double-sided copy mode nor multiple-copy mode is active, and inserts the sheet 6 along the reference guide 57 in the direction of the arrow A of FIG. 14 until the leading edge of the sheet 6 strikes the shutter portion 51. Thus, a manual-sheet-insertion start signal is generated by a button (not shown).

In response to this signal, the control section causes the eccentric cam 32 to rotate through approximately 180 degrees, thereby moving the pressure arm 31 upward. The guide plates 21 and 22 are rotated upwardly about the pins 25 by means of the push-up pieces 35 (refer to FIG. 14) to keep the upper surface of the guide plate 22 slightly below the upper surface of the lower guide 27. It is to be noted that the dimensions of the pressure arm 31 and the eccentric cam 32 are selected so that all the re-feeding transportation driving rollers 36 are positioned below the upper surface of the guide plate 22. The driven manual sheet insertion rollers 33 are pressed, by upward urging force, against the corresponding driving rollers 50 via the manually inserting sheet 6 engaged with the shutter portion 51, while the shutter portion 51, hence the guide plate 21, moves upward. Simultaneously, since the end **246*a* of the roller release arm 246 is brought into engagement with the projecting piece 49 and the inner-side portion of the roller release arm 246 is moved upward, thereby moving up the shafts 40 against the urging force of the tensile spring 43. Thus, the re-feeding transportation driven rollers 39 move to a position above the underside of the guide plate 21**.

When the above eccentric cam 32 has rotated through approximately 180 degrees, a rotation-completion signal is transmitted to the control section. In response to the signal, the control section drives the manual sheet insertion rollers 50 to transport the manually inserted sheet 6 toward the inner side at a predetermined speed (refer to FIG. 15B).

Figure 15C:
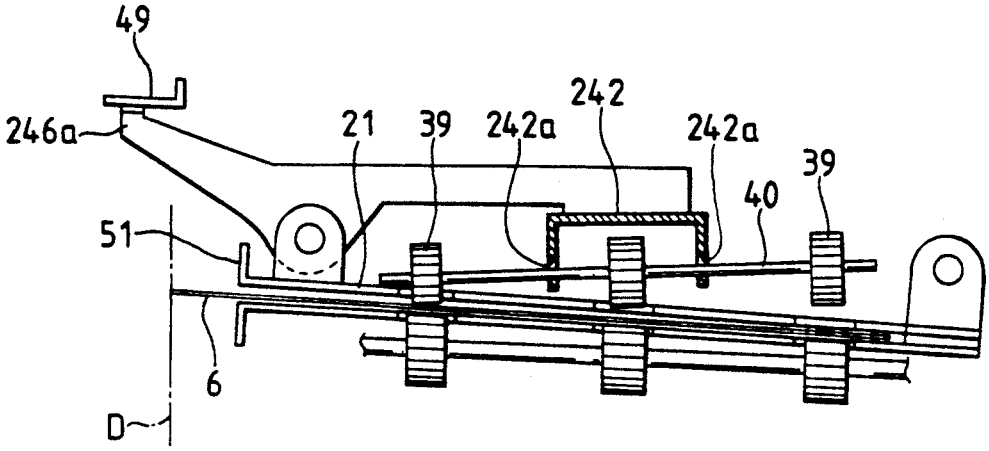

Then, after the trailing end of the sheet 6 has been detected by the sensor lever 55 and the interrupter 56, the sheet 6 is transported by a predetermined distance and the driving and driven manual sheet insertion rollers 50 and 33 are stopped. This movement causes the trailing end of the sheet 6 to coincide with the limit line D of the region C described above. The state of the sheet 6 is as shown in FIGS. 15C and 15D.

Then, when the control section receives a signal indicating that the drive source for driving the driving manual sheet insertion rollers 50 have stopped, the control section turns on the drive source for the eccentric cam 32 to cause it to rotate through approximately 180 degrees. As shown in FIG. 15C, each shaft 40 is positioned at the bottoms of the respective slots **242*a* and is inclined along the inclined axis of the bottoms. The driven re-feeding transportation rollers 39 nearest to the reference end of the sheet 6 (the limit line D), then the rollers 39 nearest to the reference end after the aforesaid rollers 39, and so on, are sequentially brought into pressure contact with the sheet 6. During this operation, each shaft 40 gradually rises from the bottom of the left-hand slot 242*a* (as viewed in FIGS. 15A to 15**D).

Figure 15D:
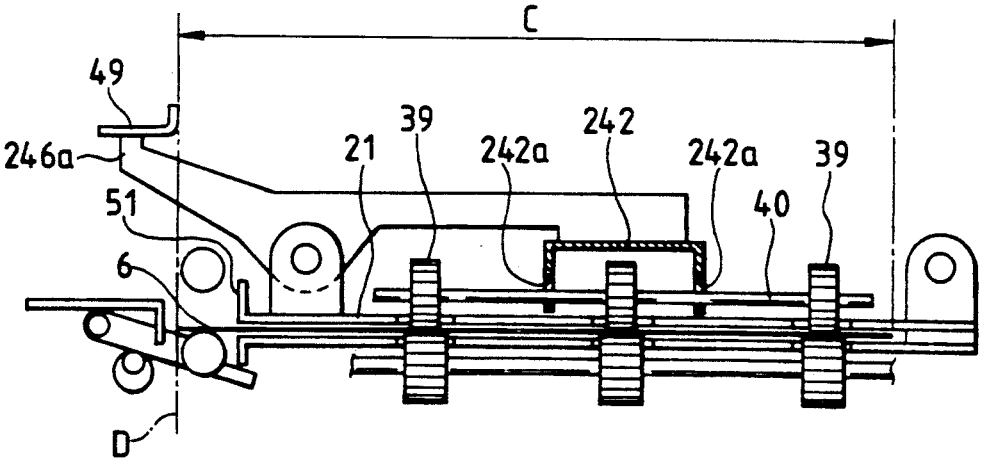

In a state wherein the left-hand roller 39 is pressed against the sheet 6, the shaft 40 is slightly separated from the bottoms of both slots **242*a*, as shown in FIG. 15D. In this manner, the sheet 6 can be appropriately pressed sequentially from the reference end portion by appropriately selecting the distance between the opposing slots 242***a*, the inclination of the roller release arm 246 during downward motion, the length of each slot 242*a*, the urging force of each tension spring 43. In this arrangement, since even a wavy sheet 6 is pressed sequentially from its reference end portion, it is possible to accurately position the sheet 6 along the transporting path (or guide plate 21). When the drive source of the eccentric cam 32 is turned of, the drive source of the rollers 36 is turned on to transport the sheet 6 in a direction substantially perpendicular to the direction of manual sheet insertion.

Figure 16A:
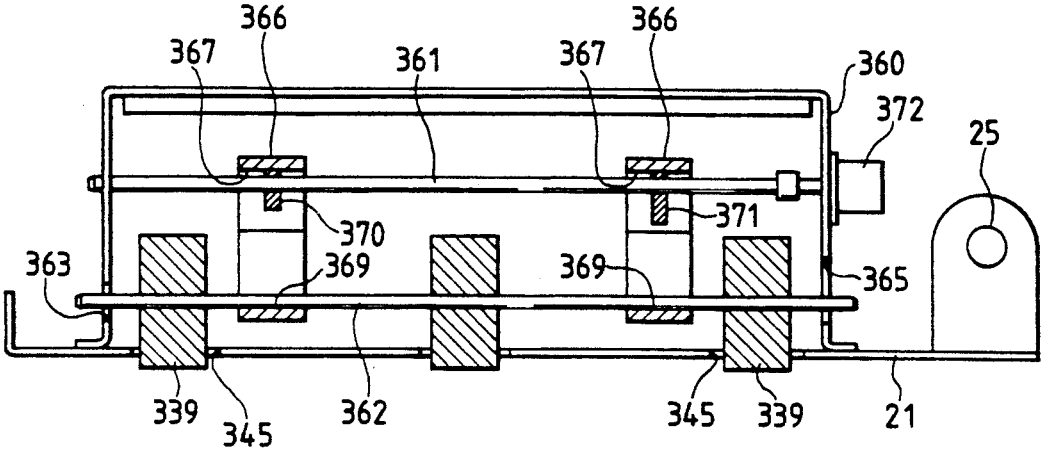
FIGS. 16A and 16B are side elevational views showing a seventh embodiment for pressing a sheet in sequence from the reference side thereof.
Figure 16B:
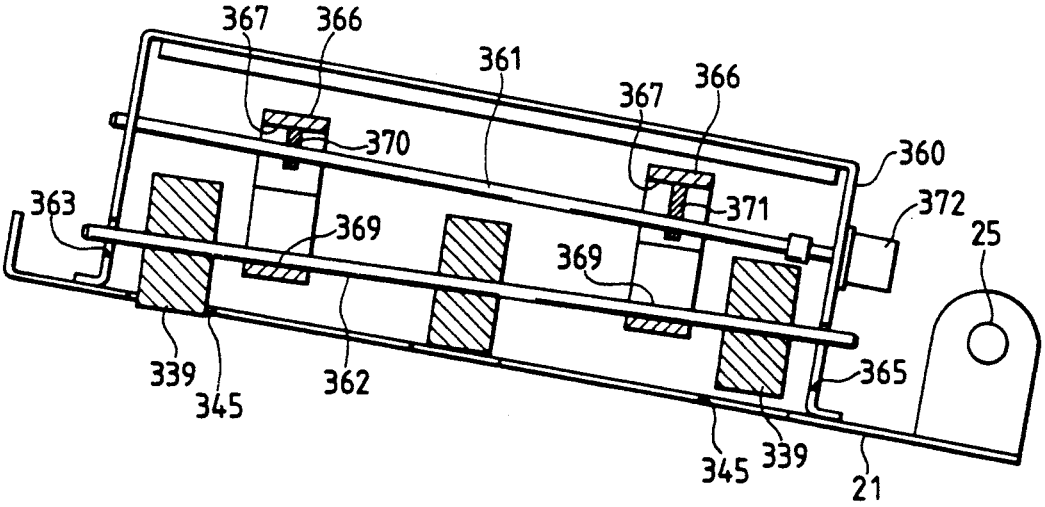

A seventh embodiment of the present invention will be described below with reference to FIGS. 16A and 16B. In FIGS. 16A and 16B, the same reference numerals are used to denote members which have substantially the same arrangements and operations as those shown in FIG. 15, and no explanation thereof is given.

A frame 360 is secured to the upper guide plate 21, and a shaft 361 is horizontally supported by the frame 360 for rotation about its axis. Opposing slots 363 and 365 are respectively formed in the front and rear sections of the frame 360 at a location below the shaft 361. A shaft 362 is supported by the slots 363 and 365 in such a manner that it is axially restricted and vertically slidable, and three refeeding transportation rollers 39 are fitted onto the shaft 362. Engagement pieces 366 each have an approximately circular opening 367 at the top and a slot 369 communicating therewith at the bottom. Eccentric cams 370 and 371 are secured to the shaft 361 and engaged with the openings 367 of the respective engagement pieces 366. The shaft 362 is engaged with the bottom of each engagement piece 366.

The shaft 361 is driven by a motor 372 mounted on the rear section of the frame 360.

The eccentricities of the cams 370 and 371 are selected so that, as shown in FIG. 16B, as the guide plate 21 moves downward, the driven re-feeding transportation roller 39 positioned on the reference end side of the sheet 6 (the left side in the drawing) initially comes into pressure contact with the sheet 6. More specifically, the motor 372 rotates the shaft 361, hence the eccentric cams 370 and 371, through 180 degrees at a time in timed relation to the eccentric cam 32 shown in FIGS. 15A to 15D.

Although each of the embodiments shown in FIGS. 15 and 16 utilizes as the reference end the left side of the sheet 6 as viewed in the corresponding drawing, the reference end may be set in the inner side of the region C used in double-sided/multiple-copy transportation. If this arrangement is adapted for the embodiment of FIG. 15, the rollers 39 can be pressed against the sheet 6 sequentially from the inner side by selecting the length or the position of each slot 242*a* of the bracket 242 shown in FIGS. 15A to 15D. In the embodiment of FIGS. 16A and 16B, it suffices to appropriately select the eccentricities of the eccentric cams 370 and 371.

As is apparent from the foregoing, in the embodiment of FIGS. 14–16, a sheet 6 is transported to a first transporting path 26 by means of first transporting means 33, 50 and then to a second transporting path 20 by means of second transporting means 36, 39. During this process, the second transporting means 36, 39 comes into pressure contact with the sheet 6 on the second transporting path 20 in sequence from the reference-end side thereof. Accordingly, even if the sheet 6 has wavy or slack portions, the slack is forced from the reference end to the sides other than it, whereby the sheet 6 can be accurately positioned on the second transporting path 20. It is accordingly possible to provide an image forming system capable of forming a faithful image and free from sheet clogging.

Moreover, since the first transporting path 26 and the first transporting means 33, 50 are arranged as a front-loading type of manual sheet insertion mechanism, no space for sideways manual sheet insertion is required. Accordingly, it is possible to remarkably improve the ease of installation of the image forming system 1.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An apparatus for transporting a sheet, comprising:
first guide means, defining a first transporting path, for guiding the sheet to an image forming section;
second guide means, defining a second transporting path, of guiding the sheet in a direction transverse to the first transporting path; and
control means for controlling a shift of said first guide means relative to said second guide means, for coupling said first transporting path with said second transporting path.

2. An apparatus according to claim 1, wherein said control means is actuated in response to a manual sheet insertion start signal.

3. An apparatus according to claim 2, further comprising a manual sheet insertion start button in communication with said control means.

4. An apparatus according to claim 1 further comprising means for moving said first guide means up and down, said moving mean being actuated in response to a manual sheet insertion signal.

5. An apparatus according to claim 4, wherein said moving means is an eccentric rotary cam.

6. An apparatus according to claim 4, wherein the second transporting path is provided with stopper means for stopping inserted sheet.

7. An apparatus according to claim 6, wherein said stopper means is disposed on said first guide means and arranged to move away from the second transporting path as said guide means moves upwardly.

8. An apparatus according to claim 4, further comprising a rotary element disposed in the second transporting path, said rotary element moving up and down as said first guide means moves up and down, and said rotary element being activated to transport the sheet from the second transporting path to the first transporting path when the first transporting path and the second transporting path are coupled to each other.

9. An apparatus according to claim 1, further comprising rotary means disposed in the first transport path, said rotary means in the first transporting path includes a pair of rotary elements, with said rotary elements being shifted toward and away from each other with the downward and upward movements of said first guide means.

10. An apparatus according to claim 9, wherein when said first guide means moves up and the first transporting path and the second transporting path are coupled to each other, said rotary elements move away from each other.

11. An image forming system comprising:

an image forming section for forming an image on a sheet;

first guide means, defining a first transporting path, for guiding the sheet to said image forming section;

second guide means, defining a second transporting path, of guiding the sheet in a direction transverse to the first transporting path; and control means for controlling a shift of said first guide means relative to said second guide means, for coupling said first transporting path and said second transporting path.

12. A system according to claim 11, wherein the first transporting path guides the sheet approximately horizontally, and an inlet of the second transporting path is disposed on a front side of said image forming system.

13. A system according to claim 12, further comprising a third transporting path for guiding the sheet to said image forming section, and cassette means for supplying a sheet to the third transporting path, with said cassette means being operable from a front side.

14. A system according to claim 13, wherein said cassette means is disposed below said second transporting path.

15. An apparatus for transporting a sheet, comprising:

first guide means, defining a first transporting path, for guiding the sheet to an image forming section;

second guide means, defining a second transporting path, for guiding the sheet in a direction transverse to the first transporting path;

control means for controlling said first and second guide means so that the first and second transporting paths can be connected and disconnected from each other by relatively shifting them from each other; and stopper means for aligning a leading edge of the sheet when the sheet is inserted into the second transporting path, wherein, when the first and second transporting paths are not connected to each other, said stopper means includes a stepped portion formed between said first guide means and said second guide means.

16. An image forming system, comprising:

an image forming section for forming an image on a sheet;

first conveying means for conveying a sheet toward said image forming section;

second conveying means or conveying the sheet in a direction transverse to the conveying direction of said first convey means, said first and second conveying means being disposed offset in a highlight direction; and height level means for levelling a height of said second conveying means and a height of said first conveying means, so that a sheet conveyed from said second conveying means is conveyed to said first conveying means.

17. An image forming system according to claim 16, wherein said first conveying means functions to re-convey a sheet on which an image is formed at said image forming section to said image forming section.

18. An image forming system according to claim 17, wherein said second conveying means conveys a sheet inserted from a front side of said image forming system toward said first conveying means.

* * * * *

UNITED STATES PATENT AND TRADEMARK OFFICE

CERTIFICATE OF CORRECTION

PATENT NO. : 5,205,551

DATED : April 27, 1993

INVENTOR(S) : TOSHIYUKI NAGANO, ET AL.

It is certified that error appears in the above-indentified patent and that said Letters Patent is hereby corrected as shown below:

COLUMN 5

Line 15, "level 52" should be --lever 52--.

COLUMN 8

Line 17, "have" should read --has--;
Line 27, "show" should read --shown--; and
Line 55, "guide plate 22" (first occurrence) should read --sheet 6--.

COLUMN 10

Line 7, "between" should read --therebetween--;
Line 22, "plate 33," should read --plate 133,--; and
Line 25, "plate 33," should read --plate 133,--.

COLUMN 13

Line 26, "refeeding" should read --re-feeding--.

UNITED STATES PATENT AND TRADEMARK OFFICE

CERTIFICATE OF CORRECTION

PATENT NO. : 5,205,551

DATED : April 27, 1993

INVENTOR(S) : TOSHIYUKI NAGANO, ET AL.

It is certified that error appears in the above-indentified patent and that said Letters Patent is hereby corrected as shown below:

COLUMN 14

Line 39, "claim 1" should read --claim 1,--;
Line 41, "mean" should read --means--; and
Line 47, "inserted" should read --the inserted--.

COLUMN 16

Line 18, "convey" should read --conveying--; and
Line 19, "highlight" should read --height--.

Signed and Sealed this

Fifth Day of April, 1994

Bruce Lehman

*Attest:*

BRUCE LEHMAN

*Attesting Officer*

*Commissioner of Patents and Trademarks*